US010472711B2

(12) United States Patent
Jee et al.

(10) Patent No.: US 10,472,711 B2
(45) Date of Patent: Nov. 12, 2019

(54) AIR KNIFE

(71) Applicant: POSCO, Pohang-si (KR)

(72) Inventors: Chang-Woon Jee, Gwangyang-si (KR); Yong-Hun Kweon, Gwangyang-si (KR); Yeon-Chae Jeung, Gwangyang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 15/578,954

(22) PCT Filed: Jun. 3, 2016

(86) PCT No.: PCT/KR2016/005947
§ 371 (c)(1),
(2) Date: Dec. 1, 2017

(87) PCT Pub. No.: WO2016/195437
PCT Pub. Date: Dec. 8, 2016

(65) Prior Publication Data

US 2018/0171461 A1 Jun. 21, 2018

(30) Foreign Application Priority Data

Jun. 3, 2015 (KR) ..... 10-2015-0078630

(51) Int. Cl.
*C23C 2/18* (2006.01)
*B05C 3/12* (2006.01)
*C23C 2/34* (2006.01)

(52) U.S. Cl.
CPC ..... *C23C 2/18* (2013.01); *B05C 3/125* (2013.01); *C23C 2/34* (2013.01)

(58) Field of Classification Search
USPC ..... 118/62, 63, 419, 420
See application file for complete search history.

(56) References Cited

U.S. PATENT DOCUMENTS 4,697,542 A * 10/1987 Kohler ..... B05C 11/06 118/63
5,423,913 A 6/1995 Fontaine
(Continued)

FOREIGN PATENT DOCUMENTS

| | | |
|---|---|---|
| CN | 103510032 | 1/2014 |
| GB | 1376521 | 12/1974 |
| JP | 47034127 | 11/1972 |

(Continued)

OTHER PUBLICATIONS

English Translation JP,05-089445,U , May 12, 2007 (Year: 2007).*
(Continued)

*Primary Examiner* — Yewebdar T Tadesse
(74) *Attorney, Agent, or Firm* — Cantor Colburn LLP

(57) ABSTRACT

An air knife includes: a nozzle main body provided so as to inject gas in response to the width of the steel plate; a nozzle lip installed on at least one of the upper section and the lower section of an outlet of the nozzle main body and extending inclinedly so that the injection cross-sectional area of the gas becomes narrow; and at least one moment generation unit, provided at one side of the nozzle lip, for generating a rotation moment so that the nozzle lip is curved in the width direction of the steel plate and a gap between other nozzle lips varies.

3 Claims, 6 Drawing Sheets

(56) References Cited

U.S. PATENT DOCUMENTS

| | | | | |
|---|---|---|---|---|
| 8,113,139 | B2 * | 2/2012 | Kim | C23C 2/20 118/62 |
| 2010/0224120 | A1 | 9/2010 | Fujioka et al. | |

FOREIGN PATENT DOCUMENTS

| | | |
|---|---|---|
| JP | 05059514 | 3/1993 |
| JP | 05089445 | 12/1993 |
| JP | 09241813 | 9/1997 |
| JP | 10140315 | 5/1998 |
| JP | 2003113457 | 4/2003 |
| JP | 2005133208 | 5/2005 |
| KR | 20020050858 | 6/2002 |
| KR | 100332896 | 11/2002 |
| KR | 20040048263 | 6/2004 |
| KR | 20150072750 | 6/2015 |
| WO | 2008069362 | 6/2008 |

OTHER PUBLICATIONS

European Search Report—European Application No. 16803790.1, dated Feb. 27, 2018, citing JP H05 89445, H05 59514, WO 2008/069362 and US 2010/224120.

International Search Report—PCT/KR2016/005947 dated Aug. 18, 2016.

Japanese Office Action—Japanese Application No. 2017-562276 dated Jan. 15, 2019, citing JP 2005-133208, JP 47-034127, JP 09-241813, U.S. Pat. No. 5,423,913, JP 05-089445, JP 2003-113457, KR 10-0332896 and KR 10-2002-0050858.

* cited by examiner

AIR KNIFE

TECHNICAL FIELD

The present disclosure relates to an air knife, and in more detail, to an air knife allowing a coating weight to be formed to be uniform according to bending of a plating material in a width direction.

BACKGROUND ART

In general, steel plate products are known as a representative steel product manufactured in steel mills. Such steel plates may be shipped and sold without a separate post-treatment after being manufactured. Operations for improving the quality of products using various post-treatment processes may be performed.

Plating processes for plating a steel plate to prevent a surface thereof from being corroded are a representative post-treatment process.

In plating processes, steel plates may be immersed in a molten plating solution, and the molten plating solution present on the steel plates may be passed through an air knife discharging high-pressure air, thereby controlling a coating weight of the molten plating solution present on the surfaces of the steel plates.

However, in the process in which the steel plates are passed through the air knife, the steel plates may be transformed by being bent in a width direction thereof. Thus, there may be differences in coating weights on steel plates.

Accordingly, in the related art, Korean Patent Application No. 10-2000-0080042 discloses a technique of a nozzle gap control device of an air knife and a method thereof. In the technique, in order to remove the effect of bending of steel plates in the width direction thereof, a gap of the air knife may be adjusted so as to allow the supply of air to be different in a width direction of the air knife.

In the related art, in order to adjust the gap of the air knife, a gap profile control device, including a plurality of air knife nozzle lip gap controllers using an electric motor and a ball screw device, have been used.

However, in the related art, driving devices controlling nozzle lips of an air knife are excessively large, displacement devices provided to transform nozzle lips interrupt operations thereof, and maintenance of the device is not easy, so that the use thereof is inconvenient. Thus, air knives, having been improved to adjust an amount of air discharged thereby, according to bending of steel plates in a width direction, are required.

DISCLOSURE

Technical Problem

An aspect of the present disclosure may provide an air knife including a nozzle lip transformed according to bending of a steel plate in a width direction thereof and having an improved structure for adjusting an amount of discharged air, thereby avoiding interference by peripheral equipment and solving problems in field work and maintenance.

Technical Solution

According to an aspect of the present disclosure, an air knife comprises a nozzle body provided to discharge a gas according to a width of a steel plate; a nozzle lip disposed on at least one side of an upper portion or a lower portion of an outlet of the nozzle body and extended diagonally to allow a cross-sectional area of the outlet from which the gas is discharged to be gradually decreased; and at least one moment generating unit provided on a side of the nozzle lip and generating a rotational moment, in order to allow the nozzle lip to be bent in a width direction of the steel plate and a gap between the nozzle lip and a further nozzle lip to be variable.

The moment generating unit may comprise an actuator disposed directly on a surface of the nozzle lip or attached to the nozzle lip by a medium of a bracket in the width direction.

The actuator may comprise an operating rod, one end of which is disposed on a surface of the nozzle lip or on a side of the bracket; and a hydraulic cylinder, a pneumatic cylinder, or an electric cylinder, connected to the other end of the operating rod to allow the other end of the operating rod to be expanded and contracted and disposed on a further side surface of the nozzle lip or on an end of the bracket.

The moment generating unit may be provided on an end surface of opposing end portions of the nozzle lip in the width direction of the nozzle lip and generate a rotational moment on at least one end portion of the nozzle lip to bend the nozzle lip.

The moment generating unit may generate each rotational moment generated on the opposing end portions of the nozzle lip, in opposite directions, in order to induce the opposing end portions of the nozzle lip to be bent and transformed in the same direction.

The moment generating unit may generate each rotational moment generated on the opposing end portions of the nozzle lip, in the same direction, in order to induce the opposing end portions of the nozzle lip to be bent and transformed in opposite directions.

Advantageous Effects

As set forth above, according to exemplary embodiments in the present disclosure, the pressure of air discharged according to bending of a steel plate may be adjusted to uniformly adjust a coating weight, and disposition space may be minimized, thereby minimizing interference by peripheral equipment and contributing to ease of maintenance.

BEST MODE FOR INVENTION

Hereinafter, the present disclosure will be described in more detail through exemplary embodiments. However, an exemplary embodiment below is intended to describe the present disclosure in more detail through illustration thereof, but not limit the scope of rights of the present disclosure, because the scope of rights thereof is determined by the contents written in the appended claims and can be reasonably inferred therefrom.

Figure 1:
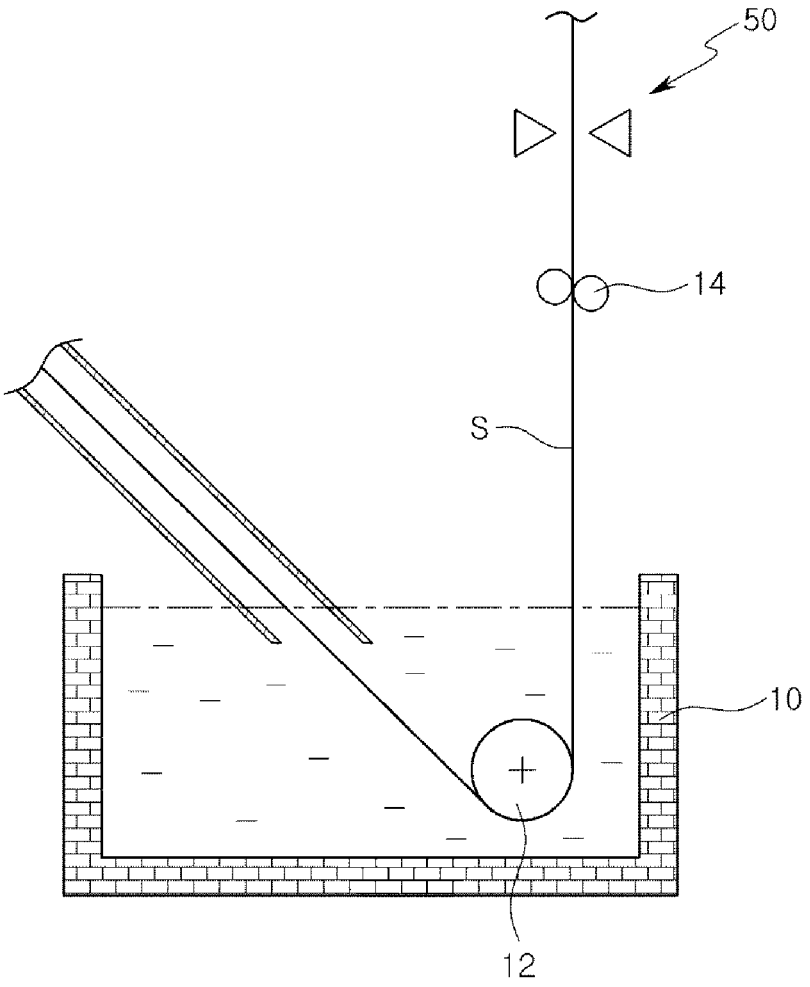
FIG. 1 is a schematic view of continuous plating equipment including an air knife according to an exemplary embodiment.
Figure 2:
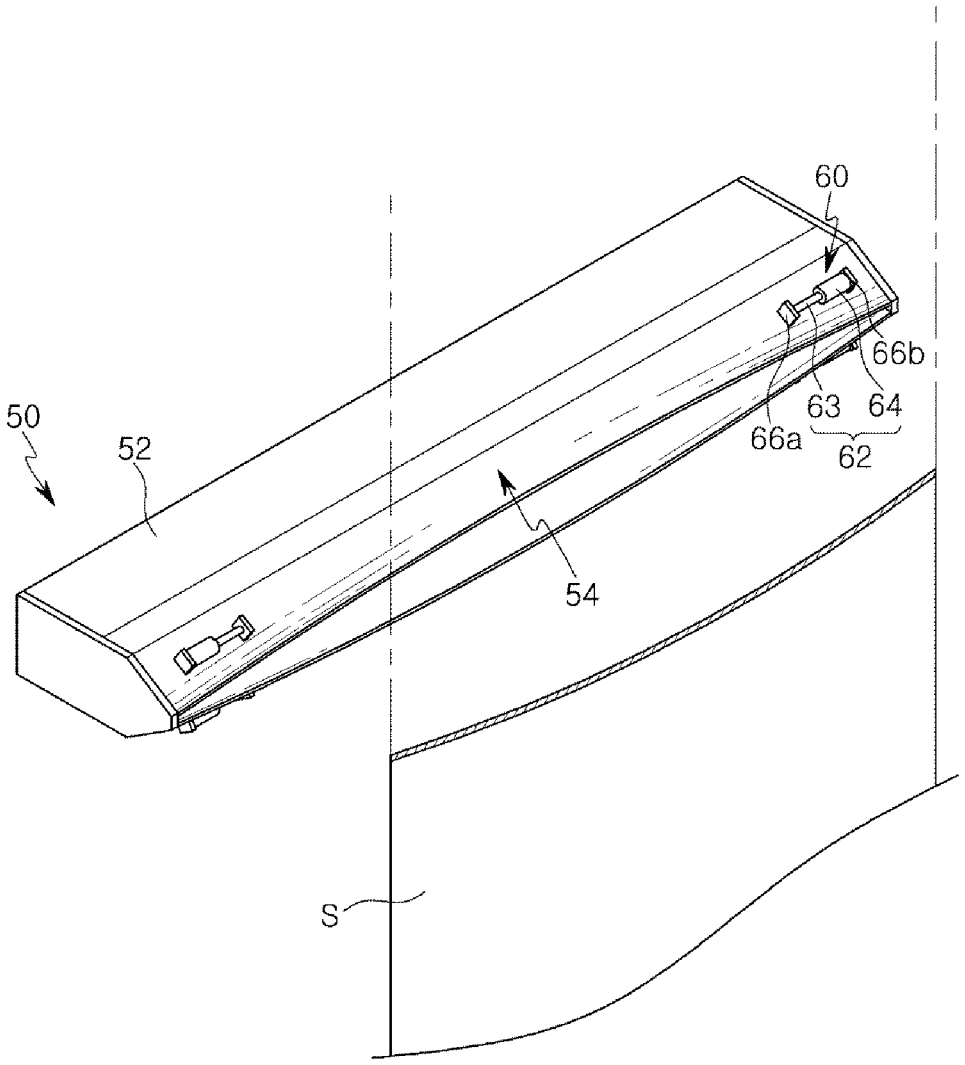
FIG. 2 is a perspective view illustrating a state in which an air knife discharges air onto a bent steel plate according to an exemplary embodiment.
Figure 3:
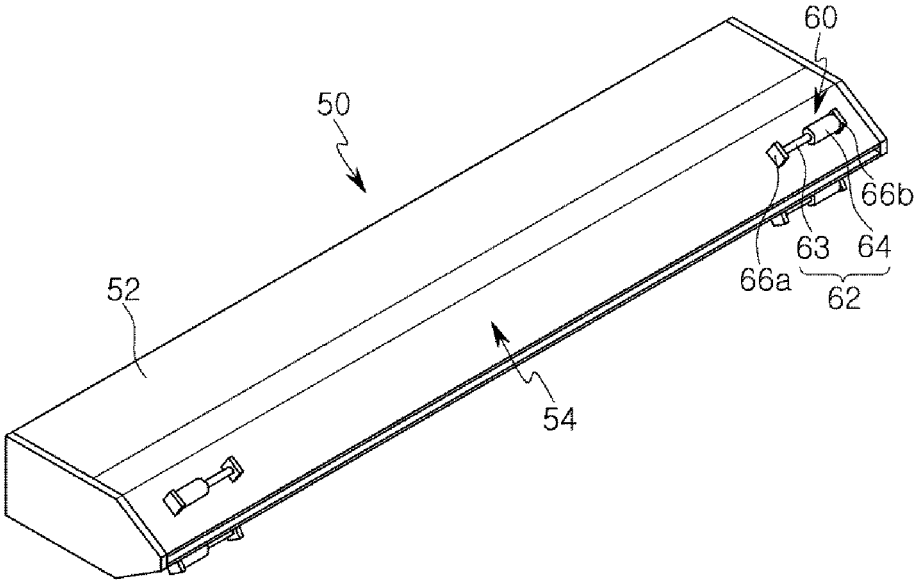
FIG. 3 is a perspective view of an air knife according to an exemplary embodiment.
Figure 4:
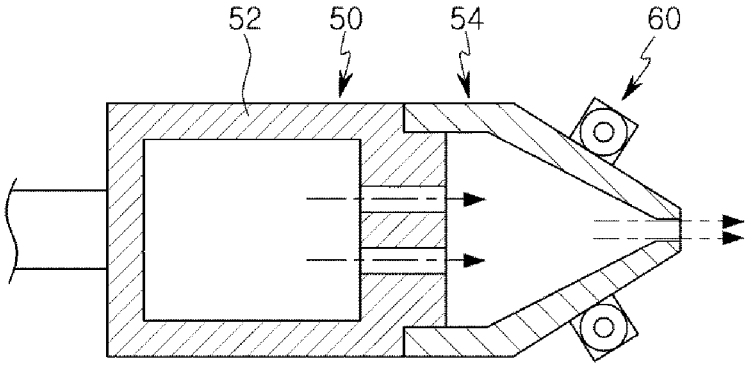
FIG. 4 is a cross-sectional view of an air knife according to an exemplary embodiment.
Figure 5:
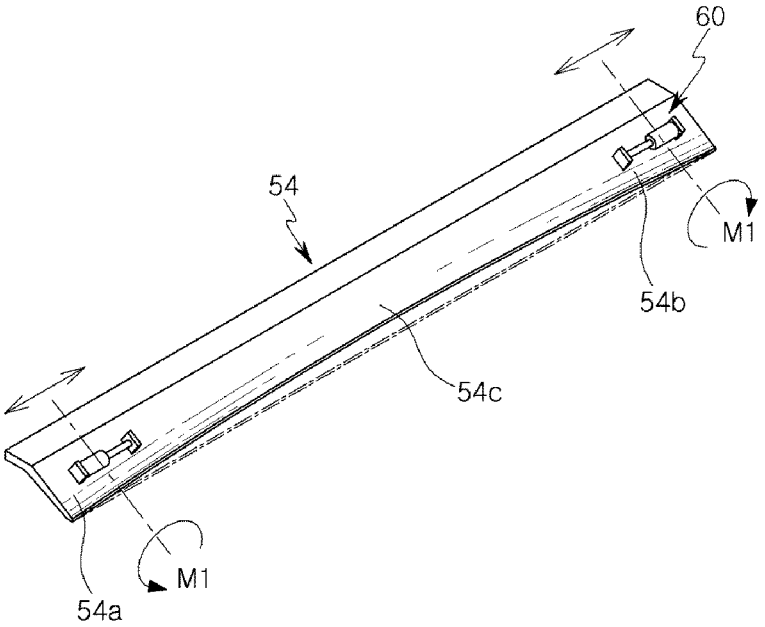
FIGS. 5 and 6 are perspective views of a portion of an air knife according to an exemplary embodiment.
Figure 6:
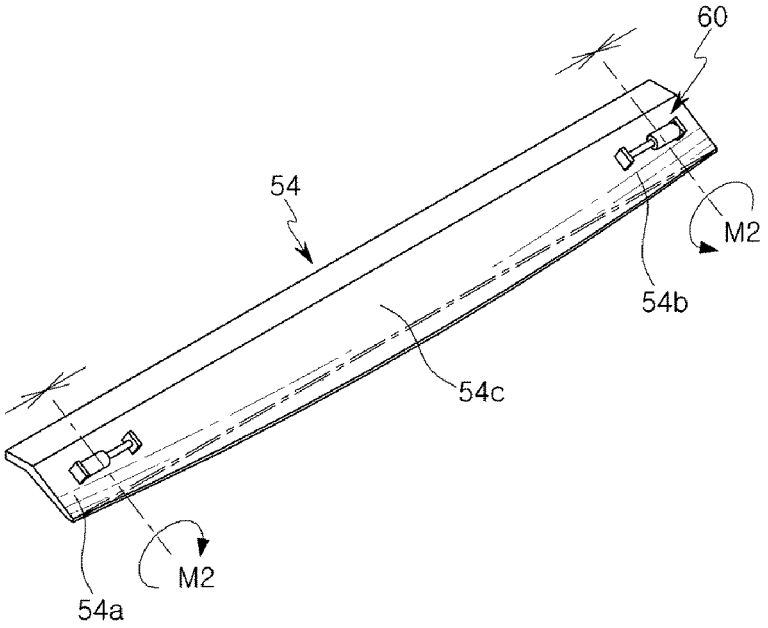

FIG. 1 is a schematic view of continuous plating equipment including an air knife according to an exemplary embodiment, while FIG. 2 is a perspective view illustrating a state in which an air knife discharges air onto a bent steel plate according to an exemplary embodiment. FIG. 3 is a perspective view of an air knife according to an exemplary embodiment, FIG. 4 is a cross-sectional view of an air knife according to an exemplary embodiment, and FIGS. 5 and 6 are perspective views of a portion of an air knife according to an exemplary embodiment.

With reference to FIGS. 1 to 6, an air knife 50 according to an exemplary embodiment may be used to adjust a coating weight by discharging high-pressure air onto a surface of a steel plate S to which a molten plating solution is attached.

The steel plate S is immersed in a plating tank 10 in which a molten plating solution may be stored. In a process in which the steel plate S is moved around a sink roll 12 and a guide roll 14 guiding the steel plate S, the molten plating solution may be attached to the surface of the steel plate S. In a process in which the steel plate S is moved around the sink roll 12 and the guide roll 14, surplus molten plating solution may be removed by high-pressure air discharged from the air knife 50.

The air knife 50 may be disposed to discharge air in a direction perpendicular to the steel plate S, in order to adjust an amount of a molten plating solution present on the steel plate S. The air knife 50 may be disposed so that air may be discharged diagonally, or may include a further air knife 50 disposed diagonally, in order to improve performance thereof.

The air knife 50 may include a nozzle body 52 provided to discharge a gas according to a width of the steel plate S. The nozzle body 52 may receive high-pressure, high-temperature air from a side thereof to be discharged into the steel plate S, thereby removing a plating solution attached to the surface of the steel plate S.

In addition, a pair of nozzle lips 54 may be disposed on at least one of an upper portion and a lower portion of an outlet of the nozzle body 52.

In an exemplary embodiment, the nozzle lips 54 are described as being disposed in an entirety of the upper portion and the lower portion of the outlet of the nozzle body 52. However, a form of the nozzle lips 54 is not limited thereto and may be transformed to have various forms. For example, the nozzle lip 54 may also be disposed on only one of the upper portion and the lower portions of the outlet of the nozzle body 52. In this case, an operation of the nozzle lip 54 may be described based on an exemplary embodiment in which the nozzle lips 54 are disposed in an entirety of the upper portion and the lower portion of the outlet of the nozzle body 52. Thus, an exemplary embodiment in which the nozzle lip 54 is disposed in only one of the upper portion and the lower portion of the outlet of the nozzle body 52 will not be described in detail.

In this case, the nozzle lip 54 is provided to increase air injection pressure by reducing a cross-sectional area of the outlet of the nozzle body 52. To this end, a pair of nozzle lips 54 may include end portions extended diagonally in a direction of the steel plate S so that the cross-sectional area of the outlet from which a gas is discharged.

In the meantime, at least one moment generating unit 60 generating a rotational moment in the nozzle lip 54 may be disposed on a side of the nozzle lip 54.

In other words, the moment generating unit 60 may generate a rotational moment so that one nozzle lip of the pair of nozzle lips may be bent in the width direction of the steel plate S, and the gap between the one nozzle lip and the other the nozzle lip may be variable.

In an exemplary embodiment, the moment generating unit 60 may be disposed on a side of the pair of nozzle lips 54. In more detail, the moment generating unit 60 may be disposed on end surfaces of opposing end portions of the pair of nozzle lips 54 in a width direction thereof.

In an exemplary embodiment, the moment generating unit 60 may generate each rotational moment generated on opposing end portions of the nozzle lip 54 in opposite directions, thereby inducing the opposing end portions of the nozzle lip 54 to be bent and transformed in the same direction.

In other words, the moment generating unit 60 may generate a rotational moment on the opposing end portions of the nozzle lip 54 in opposite directions, thereby allowing the nozzle lip 54 to be bent to be concave or convex in the width direction thereof.

In an exemplary embodiment, the moment generating unit 60 may include an actuator 62 directly disposed on the surface of the nozzle lip 54. Brackets 66*a* and 66*b* may be disposed to allow the actuator 62 to be disposed, according to a size of or a form of the actuator 62.

In an exemplary embodiment, the actuator 62 may include an operating rod 63 having an end of an end surface disposed in the nozzle lip 54 and may include a cylinder 64 connected to the operating rod 63 to be expanded and contracted and disposed on a further side surface of the nozzle lip 54. In more detail, respective end portions of the operating rod 63 and the cylinder 64 may be rotatably disposed in the brackets 66*a* and 66*b* disposed on the end surface of the nozzle lip 54. Thus, in a case in which the nozzle lip 54 is bent by a rotational moment generated in the nozzle lip 54, the actuator 62 may be stably coupled to the nozzle lip 54.

A hydraulic cylinder 64 or a pneumatic cylinder 64, expanded and contracted by hydraulic pressure or pneumatic pressure, may be used as the cylinder 64. In addition, an electric cylinder 64 using an electromagnet, a motor, or the like, may be used as the cylinder 64.

In addition, in an exemplary embodiment, the nozzle lip 54, for example, an upper nozzle lip 54 is bent in the width direction by bending transformation caused by the moment generating unit 60. Thus, a gap between the upper nozzle lip 54 and a further nozzle lip 54, opposing the upper nozzle lip 54 and forming a pair of opposing nozzle lips therewith, for example, a lower nozzle lip 54, may be changed, so that the cross-sectional area of space between the nozzle lips 54 through which air is discharged may also be changed.

In an exemplary embodiment, as illustrated in FIG. 5, in a case in which, in the air knife 50, the cylinder 64 of the moment generating unit 60 contracts the operating rod 63, a rotational moment M1 functioning outwardly in the width direction may be generated on opposing end portions 54*a* and 54*b* of the nozzle lip 54. Thus, the upper nozzle lip 54 and the lower nozzle lip 54 may be transformed to have a convex lens form in which a central portion 54*c* is convex, and the opposing end portions 54*a* and 54*b* are concave.

As such, since the central portion 54*c* of the nozzle lip 54 is formed to be convex, and the opposing end portions 54*a* and 54*b* are formed to be concave, an amount of discharged air may be increased in a center of the air knife 50 and may be decreased on opposing end portions thereof.

In the meantime, with reference to FIG. 6, in a case in which, in the air knife 50, the cylinder 64 of the moment generating unit 60 expands the operating rod 63, a rotational moment M2 functioning inwardly in the width direction may be generated on the opposing end portions 54*a* and 54*b* of the nozzle lip 54. Thus, the upper nozzle lip 54 and the lower nozzle lip 54 may be transformed to have a concave lens form in which a central portion is concave, and opposing end portions are convex.

As such, in a case in which the central portion 54*c* of the nozzle lip 54 is formed to be concave, and the opposing end portions 54*a* and 54*b* are formed to be convex, the amount of discharged air may be decreased in the center of the air knife 50 and may be increased on the opposing end portions thereof.

Here, the amount of discharged air is proportional to air injection pressure, and capability of removing a plating layer attached may be improved according to the amount of discharged air or the air injection pressure. As such, a coating weight may be controlled by adjusting the amount of discharged air or the air injection pressure.

Figure 7:
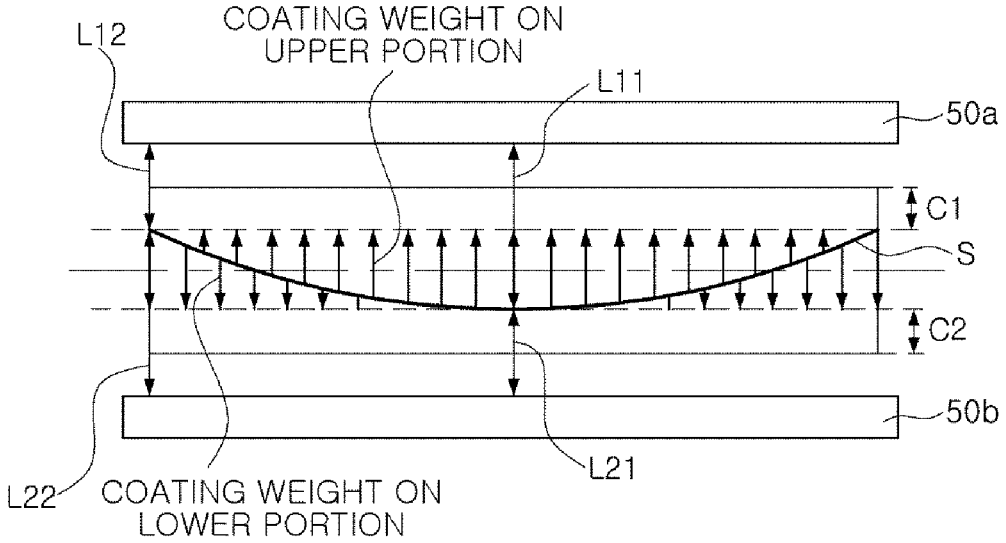
FIG. 7 is a view illustrating a plating attachment state in a case in which bending of a steel plate occurs in a width direction thereof.

FIG. 7 is a view illustrating a plating attachment state in a case in which bending of a steel plate occurs in a width direction thereof.

With reference to FIG. 7, in a case in which the steel plate S is flat in the width direction thereof without being bent, a gap between the air knife 50 and the steel plate S may be uniform in an overall width of the steel plate S. After plating work is performed, a coating weight may be uniform on each of an upper surface and a lower surface of the steel plate S.

In other words, in a case in which the gap between the air knife 50 and the steel plate S is uniform, the same amount of air is discharged in the width direction of the steel plate S, and a distance between the air knife 50 and a surface of the steel plate S from which surplus molten plating solution is removed is also uniform. Thus, pressure for removing the surplus molten plating solution from the surface of the steel plate S may be uniform.

In the meantime, in the steel plate S, bending in the width direction of the steel plate S may occur due to residual stress in the steel plate S caused by a roll, such as a sink roll 12 and a guide roll 14, guiding movement of the steel plate S during a hot dip process.

In this case, a case in which, in the hot dip process, the bending occurring in the width direction of the steel plate S is formed in such a manner that a central portion of an upper surface of the steel plate S is formed to be convex toward a lower surface of the steel plate S, has frequently occurred.

In addition, in a case in which the steel plate S is bent in the width direction, the gap between an air knife 50 and the steel plate S may be non-uniform in the width direction of the steel plate S.

In this case, since the steel plate S is bent in an arc form, a distance L11 between the central portion of the upper surface of the steel plate S and an air knife 50*a* disposed in a direction of the upper surface of the steel plate S is a maximum distance, while a distance L12 between an edge of the steel plate S and air knife 50 is a minimum distance.

In terms of distribution of distances described above, a distance between the steel plate S and an air knife 50 disposed in a direction of the lower surface of the steel plate S may be reversed. In other words, the distribution of the distances has an arc form in which a distance L21 between the steel plate S and the air knife 50*b* disposed in the direction of the lower surface of the steel plate S is a minimum distance, and a distance L22 between the air knife 50 and an edge of the steel plate S is a maximum distance.

As such, even in the case in which the same amount of air is discharged over the overall width thereof from the air knife 50, due to non-uniform distances between the upper surface of the steel plate S and the air knife 50 or between the lower surface of the steel plate S and the air knife 50, there is a difference in air pressure for removing a surplus plating solution from the surface of the steel plate S. Thus, as illustrated in the view of FIG. 7, a maximum amount of a plating solution may be attached to the central portion of the upper surface of the steel plate S. On the other hand, a minimum amount of the plating solution may be attached to the central portion of the lower surface.

In addition, with reference to FIG. 7, relations between a distance between the steel plate S and a nozzle lip 54 of the air knife 50 and a coating weight attached thereto may be confirmed.

In this case, it can be confirmed that, when the distance between the surface of the steel plate S and the nozzle lip 54 of the air knife 50 is relatively great, a greater amount of attached plating solution remains on the steel plate S.

In the meantime, in a case in which bending is formed in the steel plate S, in plating work, in order to allow a target coating weight to be attached, a reference position is moved from an upper portion of the steel plate S to the edge of the steel plate S on which a minimum coating weight C1 is formed. A plating process is performed on a lower portion of the steel plate S by setting the central portion of the steel plate S on which a minimum coating weight C2 is formed as the reference position. Thus, the target coating weight is only reached in the edge of the upper surface of the steel plate S and on the central portion of the lower surface of the steel plate S. Overcoating, an amount of which is greater than that of the target coating weight, is formed in the remainder of the portion. Overcoating causes economic losses in which a valuable and finite resource, a molten plating solution, is wasted. In alloying plated steel, a surface of which is formed through an alloying reaction by heating, there is a difference in a surface alloying process between a portion of overcoating and a plating layer on the central portion, thereby deteriorating surface quality of a product. In addition, in a case in which plating is not performed beyond the target coating weight by overcoating, a product not plated may be manufactured, thereby causing economic losses and degrading reliability.

Figure 8:
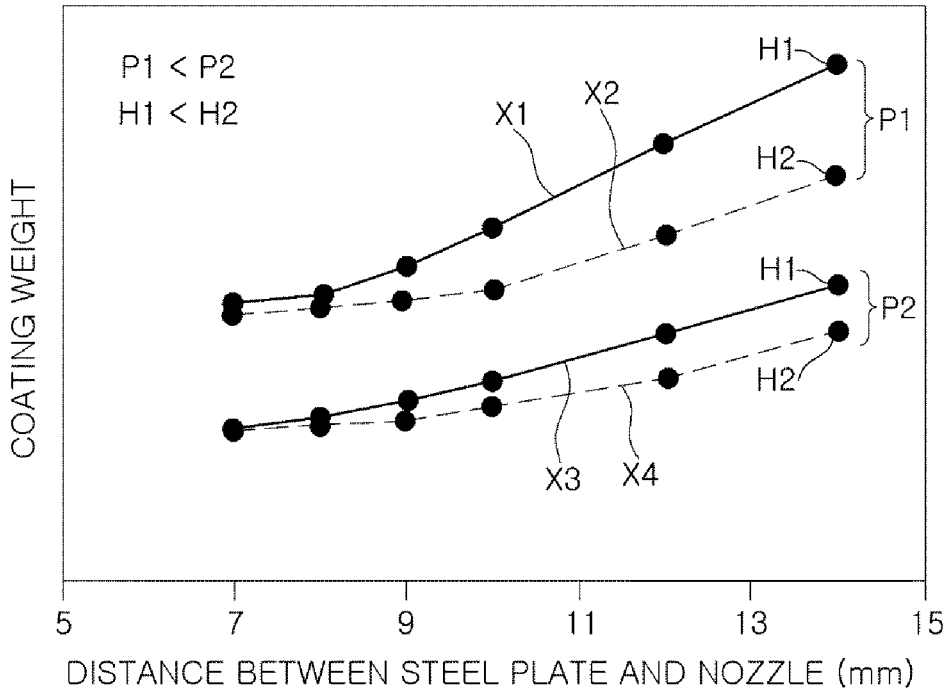
FIG. 8 is a graph of experimental results of a coating weight with respect to a distance between the steel plate and an air knife and a gap of the nozzle lips of an air knife.

FIG. 8 is a graph of experimental results of a coating weight with respect to a distance between a steel plate and an air knife and a gap of nozzle lips of the air knife.

Lines of FIG. 8 illustrate a difference in coating weights between two nozzles having a nozzle gap of hundreds of micrometers by a distance between a steel plate S and a nozzle of an air knife 50. It can be confirmed that, in a case in which a gap between nozzles is relatively great, a capability of removing surplus molten plating solution is relatively great.

In this case, X1 and X2 correspond to a case in which air pressure is P1. A nozzle gap of X1 is H1, while a nozzle gap of X2 is H2. In this case, in terms of a nozzle gap, H2 is greater than H1 (H2>H1). Thus, it can be confirmed that, when the nozzle gap is relatively great, an amount of air is increased, and the coating weight may be reduced.

In addition, X3 and X4 correspond to a case in which air pressure is P2. A nozzle gap of X3 is H1, while a nozzle gap of X2 is H2. In this case, in terms of the nozzle gap, H2 is greater than H1 (H2>H1). Thus, even in the case in which pressure is increased from P1 to P2, it can be confirmed that, when the nozzle gap is relatively great, an amount of air is increased, and the coating weight may be reduced.

Thus, a size of bending of the steel plate S in the field, or the like, is observed to be in a range of hundreds of micrometers to several millimeters. A rotational moment profiled according to the size may be generated, thereby adjusting the amount of air discharged from the air knife 50.

The air knife 50 according to an exemplary embodiment may adjust the amount of air discharged to uniformly remove the surplus molten plating solution according to bending in a width direction of the steel plate S.

To this end, a gap between the nozzle lips 54 of the air knife 50 may be adjusted using a moment generating unit provided in the nozzle lips 54. The gap between the nozzle lips 54 may be adjusted according to the extent of bending of the steel plate S, whereby the amount of air and air pressure may be adjusted based thereon.

Thus, the air knife 50 according to an exemplary embodiment may uniformly remove the surplus molten plating solution in the width direction of the steel plate S according to the adjustment of the amount of air.

In general, the nozzle lip 54 of the air knife 50 disposed in the field is manufactured to have a long thin plate-type beam having a length of 50 mm to 200 mm, extended in a direction of the steel plate S, a thickness of 5 mm to 15 mm, and a length of 2,000 mm to 2,500 mm in the width direction of the steel plate S.

It can be confirmed that, in a case in which force of about 10 kg is applied to such a long thin plate-type beam, bending transformation of 10 mm to 20 mm at the maximum may be obtained. In actuality, a gap between the nozzles of the air knife 50 used in the field is a range of 1 mm to 2 mm. In addition to a change in the expansion or contraction of hundreds of micrometers, the amount of air enough to affect the capability of removing the surplus molten plating solution may be changed.

Figure 9A:
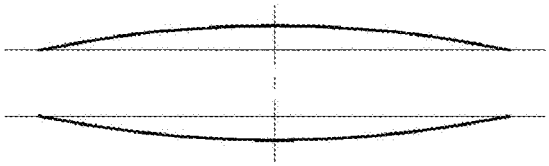
FIGS. 9A to 9E are schematic views of a bending form of the nozzle lips of an air knife according to an exemplary embodiment.
Figure 9B:
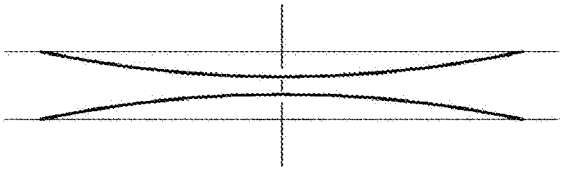

In the meantime, according to an exemplary embodiment, the moment generating unit 60 generates each rotational moment generated on opposing end portions of the nozzle lip 54 in opposite directions, thereby changing the opposing end portions of the nozzle lip 54 to be symmetrically convex or concave as illustrated in FIGS. 9A and 9B. However, the nozzle lip 54 may be transformed to have various forms, in addition thereto.

In an exemplary embodiment, the moment generating unit 60 may generate rotational moments having different magnitudes on the opposing end portions of the nozzle lip 54.

Figure 9C:
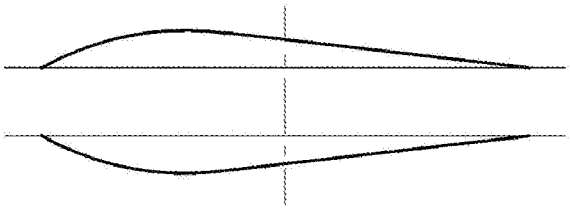

As such, in a case in which the moment generating unit 60 generates different magnitudes of rotational moments on the opposing end portions of the nozzle lip 54 as illustrated in FIG. 9C, a bending form of the nozzle lip 54 may be formed differently. In other words, maximum transformation of the nozzle lip 54 may occur in a position spaced apart from a central portion thereof by a predetermined distance.

In a case in which the steel plate S is moved in a single biased direction, a bending form of the nozzle lip 54 of the air knife 50 may be adjusted to be different according to a position of the steel plate S. Thus, even in the case in which the steel plate S is moved in a biased direction, the coating weight may be uniformly adjusted.

In addition, each rotational moment generated on the opposing end portions of the nozzle lip 54 may be generated in the same direction by the moment generating unit 60. Thus, the opposing end portions of the nozzle lip 54 may be induced to be bent and transformed to be asymmetric, for example, in opposite directions.

Figure 9D:
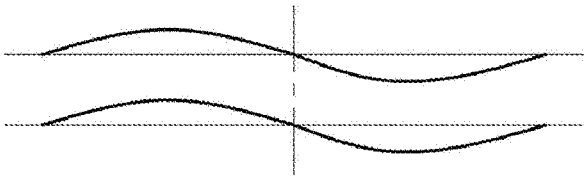

In other words, as illustrated in FIG. 9D, since the moment generating unit 60 generates a rotational moment on opposing end portions of the nozzle lip 54 in the same direction, the opposing end portions of the nozzle lip 54 may be bent and transformed in opposite directions and may be transformed to have a shape, such as a wave shape.

Figure 9E:
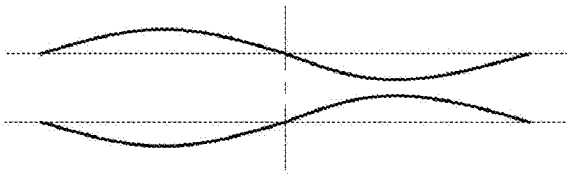

In addition, the moment generating unit 60 may allow a bending form of an upper nozzle lip 54 and a bending form of a lower nozzle lip 54 to be transformed to have a reverse shape, as illustrated in FIG. 9E.

INDUSTRIAL APPLICABILITY

As described above, the present disclosure may be used in a plating process in which a steel plate is plated to prevent a surface thereof from being corroded.

While exemplary embodiments have been shown and described above, it will be apparent to those skilled in the art that modifications and variations could be made without departing from the scope of the present invention as defined by the appended claims.

The invention claimed is:

1. An air knife, comprising:

a nozzle body having an outlet through which a gas is discharged toward a steel plate;

a nozzle lip disposed on at least one of an upper portion and a lower portion of the outlet of the nozzle body and having a lip width along a width of the steel plate; and a first moment generating unit provided on one end portion of the nozzle lip in a width direction of the steel plate and generating a rotational moment on the nozzle lip, wherein the first moment generating unit comprises: a first bracket and a second bracket directly attached on a surface of the nozzle lip, the second bracket being spaced apart from the first bracket along the width direction of the steel plate; and an actuator disposed between the first bracket and the second bracket, the actuator including: a cylinder coupled to the first bracket and an operation rod, one end of which is inserted into the cylinder and the other end of which is coupled to the second bracket, and wherein the cylinder comprises: one of a hydraulic cylinder, a pneumatic cylinder and an electric cylinder, which is configured to expand or contract the operating rod in the width direction of the steel plate between the first bracket and the second bracket to generate the rotational moment on the nozzle lip, thereby a width-direction contour of the nozzle lip being able to vary in the width direction of the steel plate with a magnitude of the rotational moment.

2. The air knife of claim 1, further comprising: a second moment generating unit disposed on the other end portion of the nozzle lip in the width direction of the steel plate.

3. The air knife of claim 1, wherein the nozzle lip is disposed on both the upper portion and the lower portion of the outlet of the nozzle body.

* * * * *